United States Patent [19]

Bieler

[11] 4,152,008

[45] May 1, 1979

[54] SKI BRAKING DEVICE

[76] Inventor: Hans Bieler, Feinmechanik, CH-7402 Bonaduz, Switzerland

[21] Appl. No.: 878,574

[22] Filed: Feb. 16, 1978

[30] Foreign Application Priority Data

Feb. 17, 1977 [CH] Switzerland ..... 1963/77
Dec. 30, 1977 [CH] Switzerland ..... 16273/77

[51] Int. Cl.[2] ..... A63C 7/10

[52] U.S. Cl. ..... 280/605; 280/634; 280/636

[58] Field of Search ..... 280/605, 604, 636, 634, 280/607; 188/5

[56] References Cited

U.S. PATENT DOCUMENTS

| | | | |
|---|---|---|---|
| 3,741,575 | 6/1973 | Bortoli | 280/605 |
| 3,873,108 | 3/1975 | Lacarrau et al. | 280/604 |
| 3,930,659 | 1/1976 | Salomon | 280/605 |
| 4,101,145 | 7/1978 | Korger | 280/605 |

FOREIGN PATENT DOCUMENTS

| | | | |
|---|---|---|---|
| 2612708 | 10/1976 | Fed. Rep. of Germany | 280/605 |
| 74505 | 1/1949 | Norway | 280/605 |
| 75461 | 1/1918 | Switzerland | 280/605 |

*Primary Examiner*—David M. Mitchell

[57] ABSTRACT

The invention proposes a braking device for a ski, particularly for braking a ski which has become detached from a ski boot and continues to run on, on its own, said device having a double-armed brake stirrup, whose arms can be tilted about an axis which runs at right angles to the longitudinal direction of the ski and which extend in the inoperative position along opposite sides of the ski, the arms being tilted into the braking position by the action of a spring, in which position the ends of the arms on one side of the axis project downwardly into the surface over which the ski is running and the ends of the arms on the other side of the axis, which are joined together and are intended to be pressed down by the ski boot, are tilted upwardly after separation of the ski boot from the ski. The spring for tilting the stirrup is tensioned between said connected ends of said arms and a mounting plate, defining a line of action extending substantially through said axis in said inoperative position. Additionally a leaf spring is provided engaging with said stirrup to initiate operation of said device by said spring means.

10 Claims, 6 Drawing Figures

Fig. 2
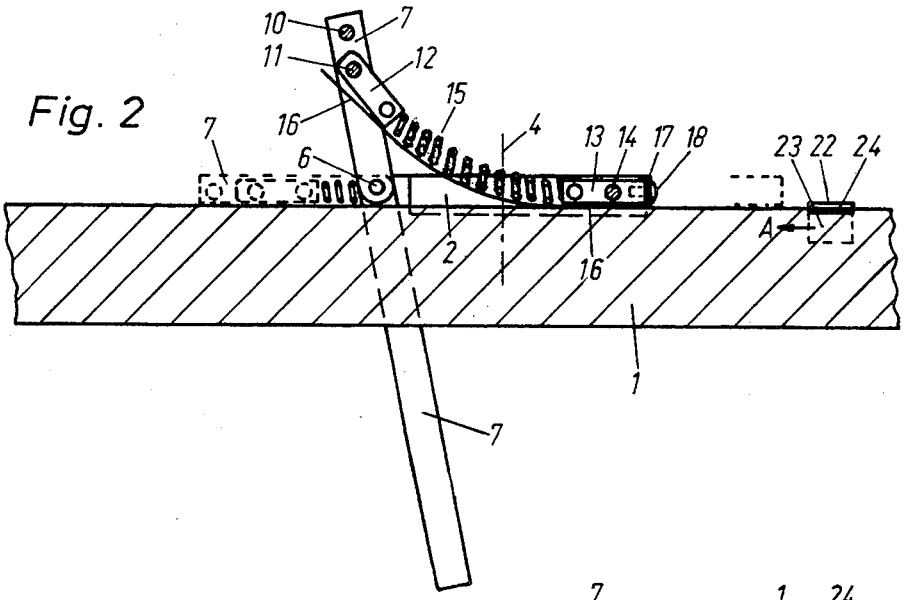
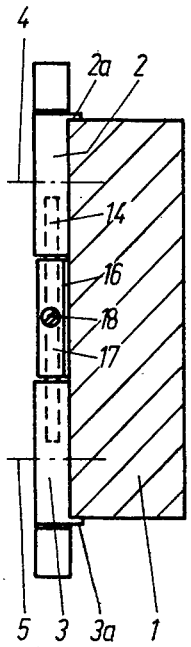
Fig. 3
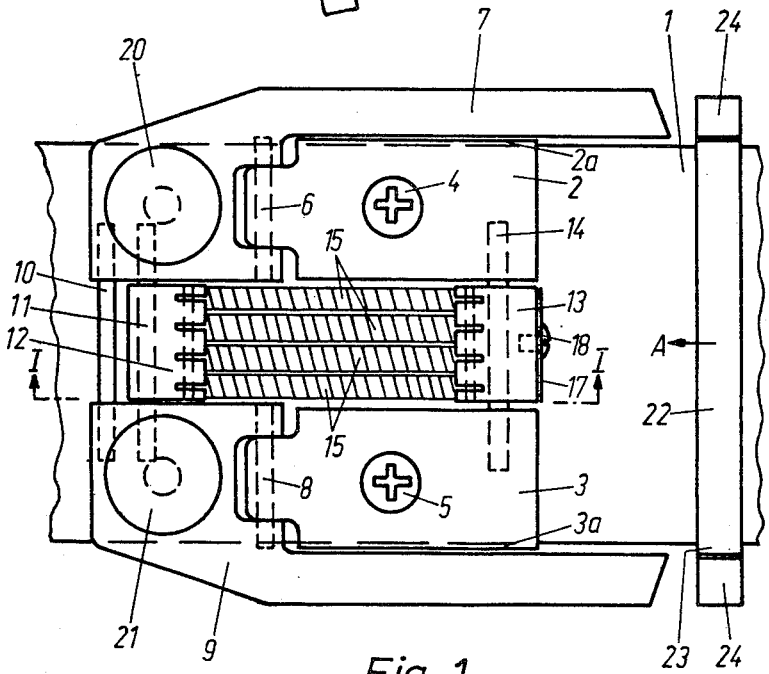
Fig. 1

Fig. 5
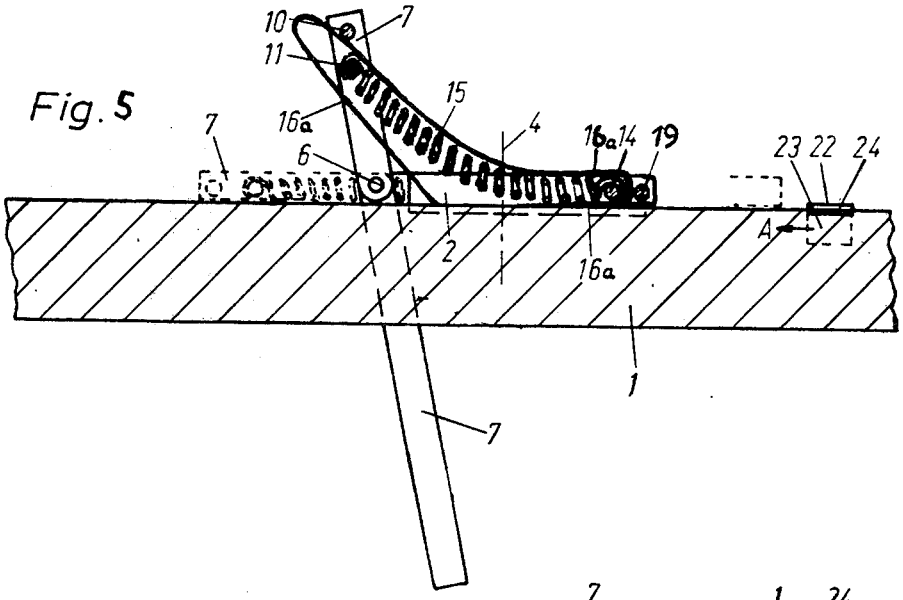
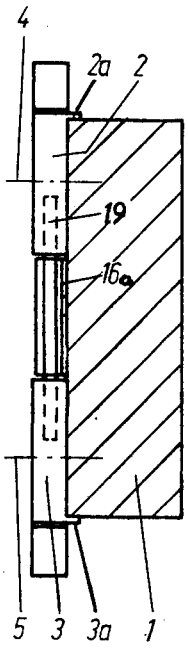
Fig. 6
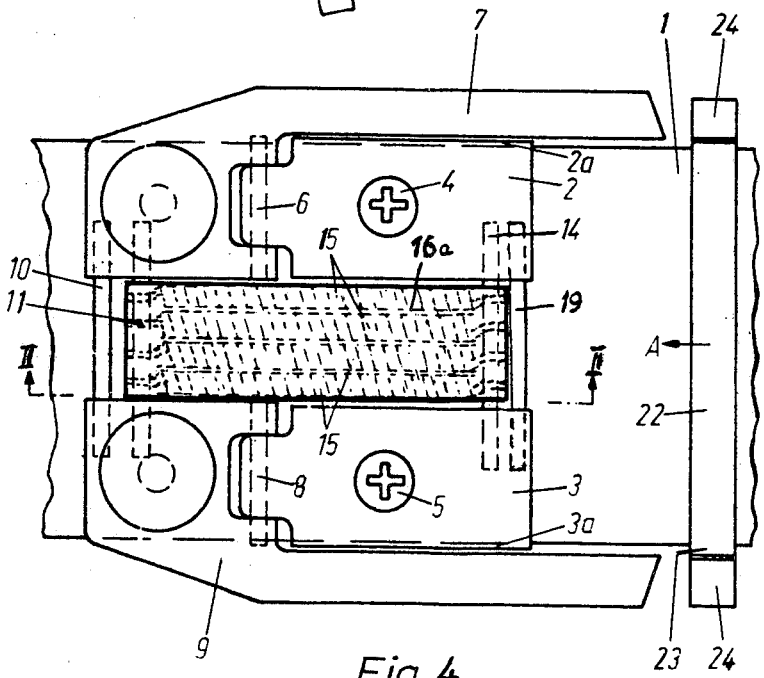
Fig. 4

SKI BRAKING DEVICE

The present invention relates to a braking device for a ski, particularly for braking a ski which has become detached from a ski boot and continues to run on, on its own. The device is of the type having a double-armed brake stirrup, whose arms which can be tilted about an axis which runs at right angles to the longitudinal direction of the ski and which extend in the inoperative position along opposite sides of the ski, the arms being tilted into the braking position by the action of a spring, in which position the ends of the arms on one side of the axis project downwardly into the surface over which the ski is running and the ends of the arms on the other side of the axis, which are joined together and are intended to be pressed down by the ski boot, are tilted upwardly after separation of the ski boot from the ski.

In known ski braking devices of the above described nature, which is each case are mounted on the ski in the region of the ski binding between the head part and the heel part of the binding, the braking stirrup is pressed downwards by the ski boot in its inoperative position, and is under high spring pressure, so that when a skier falls and the ski becomes detached from the ski boot the braking lever is brought into the braking position. In order to bring the braking stirrup back into the inoperative position, it must, in various known devices, be swung back by hand against the effect of the spring to a position where it can be locked by a holder part (this locking being released automatically when the ski boot is placed in the binding) in order that the braking stirrup is again located in the position where it is ready for action, in which the full pressure of the spring operates against the lower surface of the ski boot. In other known braking devices of this type the holder for locking the braking stirrup is not used, the springs for actuating the braking devices being tensioned by the ski boot when this is placed in the binding.

In each case the relatively high spring pressure which is operative on the lower surface of the ski boot which is necessary in order to ensure operation of the braking device is very disadvantageous for the safety of the ski binding itself, since the forces which operate on the ski boot as a result of this are completely changed with respect to those for which the release mechanism of the ski binding is intended. The effects of force due to pressure, friction etc. originating from the braking device are however too indefinite, to take into account the needs of the safety binding.

The basic aim of the present invention hence consists of improving a braking device for a ski in one important point in order that the force which is necessary for its initiation and which operates on the ski boot in the position where it is ready to operate is very small and lies below the value which is required by safety experts and, after initiation of the braking action after separation of the ski and the ski boot, the force then increasing to a greater value in order to safely ensure a swinging of the braking stirrup into the braking position, in which the braking stirrup is inclined at an angle of about 90° to the ski.

According to the invention a braking device for a ski, adapted to operate when a ski boot has become detached from said ski, comprises a braking stirrup, said stirrup having a pair of arms connected together at one end; means for mounting said stirrupon said ski, said mounting means defining an axis transverse to the longitudinal direction of said ski, and said stirrup being tiltable about said axis between an inoperative position in which said arms lie substantially parallel along the sides of said ski and an operative braking position in which said connected ends of said arms extend upwardly from said ski and the free ends of said arms extend downwardly to stop said ski; spring means, for tilting said stirrup, tensioned between said connected ends of said arms and said mounting means, defining a line of action extending substantially through said axis in said inoperative position; and a leaf spring engaging with said stirrup to initiate operation of said device by said spring means.

This arrangement has the advantage that a tilting moment is only operative on the braking stirrup once said braking stirrup, with which the tensioning springs engage, is tilted out of this plane by the force acting on the braking stirrup arising from the additional leaf spring. During the tilting movement of the braking stirrup and up to the braking position the vertical spacing between the attachment point of the spring on the braking stirrup and the axis of tilting and consequently the effective length of the effort arm and consequently also the force which swings the braking stirrup into the braking position becomes increasingly greater.

In order to keep the installation height of the braking device as low as possible, which means that no part should be present which projects above the flat braking stirrup, it is preferable to use a spring set consisting of several tensioning springs which are arranged side by side and parallel to each other in order to produce an adequate spring force, this being, arranged to be symmetrical with the longitudinal center of the braking stirrup, one end of the spring being fastened on a part of the device which is intended for attachment on the upper surface of the ski and the other end of the springs being fastened on a part of the braking stirrup which connects the ends of the arms, which can be tilted upwardly, of the braking stirrup together.

The leaf spring which engages additionally with the braking stirrup for initiating the swinging movement into the braking position can be arranged below the spring set, in which case one end of the leaf spring is attached to the part of the device which is intended for mounting on the upper surface of the ski, whilst the free end of the leaf spring acts in the central longitudinal region against part of the braking stirrup which connects the arms of the braking stirrup, which can be tilted upwardly, together.

However it is easy for snow to penetrate into the spring set consisting of tension springs which are side by side and arranged to be parallel to each other and which is open at the top. This however does not upset the operation, but it is advantageous to prevent snow from entering at this point, since in any case its safety is enhanced and above all the device takes on a better appearance when the spring set is not visible and the upper surface of the device is formed by smooth surfaces, which lie in one plane, when the braking stirrup is in the inoperative position.

In a particularly preferred embodiment of the braking device a ski spring set, which is arranged symmetrically with the longitudinal central line of the braking stirrup and consists of several tensioning springs which are arranged parallel and side by side is covered by a leaf spring which extends over it and parallel to it, one of whose bent over ends is attached to the part which is intended for fastening on the upper surface of the ski and whose other bent over end surrounds the part of the braking stirrup which connects the ends of the arms which can be tilted upwardly together and engages with this in order to initiate the swinging motion into the braking position.

A further aim of the present invention consists of arranging the braking device for a ski in such a manner, that it can very easily be adapted to different widths, in order that the spacing between the arms of the braking stirrup which tilts on both sides of a ski is on the one hand not too large and on the other hand not too small, in which latter case it would be impossible to mount the braking device on a ski. In order to meet this requirement in a preferred further refinement of the invention the arms of the braking stirrup are each pivoted on base plates which are intended for assembly onto the ski, and which are arranged on both sides of the spring set, in such a way that the two axes of tilting are aligned, the two base plates as well as the two arms of the braking stirrup being connected together by means of transversely running pins, which in each case have at one end a sliding seating, which allows for a change in spacing of the two arms of the braking stirrup and the two base plates with respect to each other for the purpose of adapting the braking device for a ski to differing ski widths.

In order to simplify assembly, each base plate has advantageously on one longitudinal side an abutment edge which projects downwardly, which is intended to engage with the side edge of the ski. In order to fit the braking device for a ski it is only necessary to fasten the two base plates with one screw each, which makes possible very fast fitting.

Further details and advantages of the invention will become clear from the description below and the drawings, in which an embodiment of the invention is given purely by way of example.

FIG. 1 shows a top view of a first embodiment of a braking device for a ski which is mounted on a ski in the inoperative position of the brake stirrup;

FIG. 2 shows a longitudinal section through the braking device along the line 1—1 in FIG. 1 with the brake stirrup swung into the braking position;

FIG. 3 shows a view from the rear of the braking device of FIG. 1;

FIG. 4 shows a top view of a second, preferred embodiment of a braking device for a ski which is mounted on a ski in the inoperative position of the brake stirrup;

FIG. 5 shows a longitudinal section through the braking device of FIG. 4 along the line 11—11 in FIG. 4, with the braking stirrup swung into the braking position; and, FIG. 6 shows a rear view of the braking device of FIG. 4.

As shown in FIGS. 1 to 3 two base plates 2, 3 are fastened on a ski 1, side by side at a distance apart, each with a screw 4,5. When assembling these base plates it is only a question of bringing in each case an abutement edge *2a* or *3a* which projects downwardly on the outer longitudinal side into abutment with the side edge of the ski, so that the assembly of the braking device for a ski onto the ski is very simple.

One arm 7 of a braking stirrup is attached to the base plate 2 by means of a tilting axis 6 and the other braking stirrup arm 9 is attached to the base plate 3 by means of a tilting axis 8. The front ends of the arms 7 and 9 (with regards to the direction of travel) are connected together by means of two transverse pins 10 and 11 and together form a double-armed braking stirrup. The forward pin 10 serves only to strengthen the connection between the two arms 7 and 9 of the braking stirrup, whilst the rear pin 11 also extends transversely through a spring holder 12, which can tilt on the pin 11.

A spring holder 13 having an identical construction to the spring holder 12 is attached to the base plate 2 and 3 by means of a pin 14 which passes right through it transversely, in such a way that it is located in the space between the two base plates in the same plane.

To this first spring holder, which is attached to the upper surface of the ski, are attached the ends of four helical coil springs 15 which are arranged to be parallel and side by side and which together form a set of springs, whose other ends are attached to the forward spring holder 12. The set of springs is located in the inoperative position of the braking stirrup in a common plane with the stirrup and the two base plates, parallel to the upper side of the ski, as can be seen in FIG. 1 and FIG. 2 (where the inoperative position of the braking stirrup is shown in dashed lines).

In the inoperative position of the double armed braking stirrup the springs 15 of the spring set are under tension. As can be seen in FIG. 2, the line along which the springs act in the position of the braking stirrup shown in FIG. 2 in dashed lines is a straight line passing through the axes of tilting 6,8. This means that the braking stirrup is located in a dead point position, in which no rotational moment is acting on it from the spring 15. In this position the braking stirrup is held down by the ski boot which is firmly attached with the ski binding (not shown) when the ski binding causes the ski boot to become free when the skier falls, so that the boot is no longer pressing the braking stirrup down, the latter must immediately be swung into the braking position shown in FIG. 2, in order to stop the ski. In order to initiate the required tilting motion of the braking stirrup out of the dead position into the braking position, a leaf spring 16 is arranged below the set of coil springs 15, which extends up to the outer end of the spring holder 13, where the bent over end 17 of the leaf spring 16 is attached by means of a screw or rivet 18. The free end of the leaf spring 16 presses against the lower side of the spring holder 12, in the inoperative position of the braking stirrup shown in FIG. 1 with a small force of the order of magnitude of about 3 kilograms force, which force ensures that the braking stirrup is swung out of the dead position. As soon as this has happened, the stretched springs 15 have their full effect. At the same time the force which is operating on the braking stirrup, which is tilting it into the braking position, becomes greater during the course of this swinging motion, since the effective length of the level arm provided by the vertical distance between the axis of tilting and the point of action of the spring becomes greater, so that the force operating on the braking stirrup increases by up to three times the value of the force operating on it in the inoperative position. This is the particular advantage of the ski-braking device described and which distinguishes it from other known devices in the art With the present device the force which is operating on the underside of the ski boot for initiation of the braking device lies, as required by the technical supervisory body, below the value of 5 kilogrames force in order to ensure that any influence on the safety of the ski binding is negligible.

With respect to the safety of the ski binding, which should be able to open without coming under the influence of the braking device for the ski, and where the ski boot is twisted sideways out of the binding, circular discs 20 and 21 of a plastics material with good sliding properties are let in and fastened on the upper surface of the two ends of the arms 7 and 9 which are tilted upwards in use. These discs, which are preferably made of Teflon, represent the contact surface between the braking stirrup and the ski boot, which due to the good sliding properties of this material can move away easily from the braking stirrup, when the ski binding opens.

As has already been mentioned above, the ski-braking device should be able to be mounted on skis of different widths using few hand operations. Adjustment is hence required for the width of the device, in order for the two arms 7 and 9 of the braking stirrup always to have the same spacing form the longitudinal sides of the ski. The mutual spacing apart of the two arms 7 and 9 and of the two base plates 2 and 3 can be changed for this purpose. In order to make this possible, the two pins 10 and 11 which join the arms 7 and 9 together have a sliding seating in one arm, whilst the opposing end of the pin is fastened in the other arm with a compression seating. This is possible without influencing the stability of the braking stirrup, since each individual arm is carried by means of a tilting axis 6 or 8 on one base plate 2 or 3. In the same way the relative spacing of the two base plates can be changed, since the pin 14 which connects the base plates together is fitted with a sliding seating at one end and a compression seating at the other end.

When assembling the braking device on a ski it is consequently only necessary to bring the two base plates 2 and 3 with their abutment edge 2*a* or 3*a* (already mentioned above) in to abutment against the side edges of the ski. The two arms 7 and 9 of the braking stirrup then come to be located in the correct position. For assembly it is only necessary to provide two holes on the ski for the fastening screws 4 and 5, the correct location of these holes being quickly determined by means of a gauge which is adjusted to the ski width.

The preferred second embodiment of ski-braking device which is shown in FIGS. 4 to 6, conforms to the first embodiment according to FIGS. 1 and 3 with the exception of the leaf spring and the fastening method of the coil springs. The arm of the braking stirrup is attached to base plate 2 at a tilting axis 6 and the arm 9 of the braking stirrup is attached to the base plate 3 at a tilting axis 8, which arms 7 and 9 are connected together by means of two pins 10 and 11 which are at the forward end with respect to the direction of travel, and together form the double-armed braking stirrup. The forward pin 10 serves only to strengthen the connection between the two arms 7 and 9 of the braking stirrup, whilst the ends of the spiral springs 15 are fastened to the rear pin 11.

The base plates 2 and 3 are connected together using pins 19 and 14. The other end of the coil springs 15 are attached to the pin 14. Four coil springs 15, which are arranged parallel side by side, form the spring set, which in the inoperative position of the braking stirrup lies in a plane which is parallel to the upper surface of the ski and which is common to the braking stirrup and the two base plates 2 and 3, as can be seen in FIGS. 4 and 5 (in which the inoperative position of the braking stirrup is shown in dashes lines).

In order to initiate the swinging motion of the braking stirrup out of the dead position, a leaf spring 16*a* is arranged above the spring set. This leaf spring is extended at both ends by a bent-over portion which passes between the pins 19 and 14, where the leaf spring end is rigidly clamped between the top surface of the ski and the end of the coil springs 15, when the base plates 2 and 3 are screwed onto the ski. The other curved over end of the leaf spring 16*a* extends between the pins 10 and 11 to the underside of the spring set, where the edge of this spring end rests, in the upwardly tilted braking position of the braking stirrup, on the upper surface of the ski. In this way no snow gets to the spring set even in this position. This leaf spring only has the purpose of tilting the braking stirrup out of the dead position. As shown as this has taken place, the tensioned springs 15 exert their full effect and allow the braking stirrup out of the dead position. As soon as this has taken place, the tensioned springs 15 exert their full effect and allow the braking stirrup to move smartly, with a high force, into the braking position.

In order to be able to lock the braking stirrup in the inoperative position, for example when practicing cross-country skiing, for transport of the skis or in order to wax them etc., a locking stirrup 22 is provided which can be seen in FIG. 1 and 2, and 4 and 5. The locking stirrup is separate and can be placed on the ski extending transversely across the ski and beyond it and is pressed by means of two side pieces 23 in a sprung manner against the longitudinal sides of the ski. At the level of the upper surface of the ski an abutment wing 24 is provided on each opposing side, against which the respective arm of the braking stirrup, which is under spring tension, abuts, so that when the locking stirrup 22 is slid in the direction of arrow A under the braking stirrup, the braking stirrup is locked in the inoperative position.

I claim:

1. A braking device for a ski, adapted to operate when a ski boot has become detached from said ski, said device comprising a braking stirrup, said stirrup having a pair of arms connected together at one end; means for mounting said stirrup on the ski, said mounting means defining an axis transverse to the longitudinal direction of said ski, and said stirrup being tiltable about said axis between an inoperative position in which said arms lie substantially parallel along the sides of said ski and an operative braking position in which said connected ends of said arms extend upwardly from said ski and the free ends of said arms extend downwardly to stop said ski; spring means, for tilting said stirrup, tensioned between said connected ends of said arms and said mounting means, defining a line of action extending substantially through said axis in said inoperative position; and a leaf spring engaging with said stirrup and acting along a second line of action intersecting the first said line of action to initiate operation of said device by said spring means.

2. A device according to claim 1, wherein said spring means comprises a spring set consisting of several tension springs, said springs being arranged parallel to each other and side by side, and said sprig set being arranged symmetrically with respect to the longitudinal midpoint of said braking stirrup.

3. A device according to claim 2, further comprising a first spring holder body and a second spring holder body, one end of said spring set being attached to the first holder body and the other end being attached to said second holder body, said second holder body being fastened to said connected ends of said arms of said braking stirrup and said first holder body being attached to said mounting means.

4. A device according to claim 3, wherein said leaf spring extends below said spring set, one of said ends of said leaf spring being attached to said first spring holder body, and the free end of said leaf spring pressing against said second spring holder body.

5. A device according to claim 2, wherein said spring set is covered by said leaf spring which extends over it and substantially parallel to it, said leaf spring having a first bent-over end attached to said mounting means, and a second bent-over end which surrounds a braking stirrup part connecting said connected ends of said arms and engages with said braking stirrup part, in order to initiate tilting.

6. A device according to claim 5, wherein said mounting means comprises a pair of transversely spaced base plates and wherein said springs are each attached at one end to a pin which connects said base plates together, and under which said first bent-over end of the leaf spring is clamped, each of said springs being attached at its other end to said braking stirrup part, said braking stirrup part comprising a second pin which connects said ends of said arms, said second pin being surrounded by said second bent-over end of said leaf spring, said leaf spring exerting its force on said second pin to tilt the braking stirrup out of the inoperative position.

7. A device according to claim 1, wherein each of said arms is tiltable on a respective base plate forming said mounting means, said base plates being connected together by a transverse pin and wherein said connected ends of said arms which can be tilted upwardly of the braking stirrup are connected together by a second transverse pin, each of said pins having at one end a sliding seating, which allows change in the spacing of said two arms of the braking stirrup and of said two base plates with respect to each other for adapting said braking device to different ski widths.

8. A device according to claim 7, wherein each of said base plates has on one longitudinal side an abutment edge, said edge projecting downwardly for abutment against the side edge of said ski.

9. A device according to claim 1, wherein the upper surface of the end of each of said arms which can be tilted upwardly includes a disc of a plastics material to enable sliding of said ski boot thereover.

10. A device according to claim 1, which includes a locking stirrup to lock the braking stirrup in said inoperative position said locking stirrup engaging with said ski on three sides and having projecting wings on its opposing sides means mounting said locking stirrup for selective positioning in the longitudinal direction on said ski to lie under the free ends of said arms which can be tilted downwardly of the braking stirrup to retain said braking stirrup in said inoperative position.

* * * * *

UNITED STATES PATENT AND TRADEMARK OFFICE

CERTIFICATE OF CORRECTION

PATENT NO. : 4,152,008

DATED : May 1, 1979

INVENTOR(S) : Hans Bieler

It is certified that error appears in the above-identified patent and that said Letters Patent are hereby corrected as shown below:

Column 6, line 60, change "sprig" to --spring--.

Signed and Sealed this

*Twenty-first* Day of *August 1979*

[SEAL]

*Attest:*

*Attesting Officer*

LUTRELLE F. PARKER

*Acting Commissioner of Patents and Trademarks*